United States Patent [19]

Luker

[11] 4,353,474

[45] Oct. 12, 1982

[54] LOAD BEARING CLOSURE

[75] Inventor: Charles E. Luker, Evansville, Ind.

[73] Assignee: Sunbeam Plastics Corporation, Evansville, Ind.

[21] Appl. No.: 272,294

[22] Filed: Jun. 10, 1981

[51] Int. Cl.[3] ..... B65D 55/02

[52] U.S. Cl. ..... 215/220

[58] Field of Search ..... 215/219, 220

[56] References Cited

U.S. PATENT DOCUMENTS 3,853,236 12/1974 Ostrowsky ..... 215/220

4,319,690 3/1982 Birrell et al. ..... 215/220

*Primary Examiner*—George T. Hall

*Attorney, Agent, or Firm*—Fisher, Gerhardt, Crampton & Groh

[57] ABSTRACT

A screw type load bearing closure having a relatively flexible outer cap and a relatively rigid inner cap nested together. The caps are provided with complementary engaging ribs and lugs making it possible to turn the caps as a unit in a closing direction but permits relative rotation of the caps upon rotation of the outer cap in an opening direction unless the outer cap is simultaneously deflected axially relative to the inner cap. Complementary load bearing surfaces are provided on the caps to prevent axial deflection when the caps are in a predetermined position to prevent axial deflection and possible permanent set of the outer cap relative to the inner cap.

11 Claims, 6 Drawing Figures

LOAD BEARING CLOSURE

This invention relates to child-resistant screw-type safety closures.

There are a large variety of safety closures of the screw-type which include outer and inner caps permitting closing of a container by turning the caps as a unit but which permit relative rotation in an opening direction precluding removal of the closure. In addition to rotation, removal requires axial deflection of one cap relative to the other to engage complementary driving elements permitting rotation of the caps as a unit and therefore removal from a container. Proper functioning of such closures requires that the deflectable outer cap returns to its original, as molded position after removal from and replacement on a container. However, after containers are filled and closed for the first time, they frequently are packed in stacks in boxes for shipment or are displayed in stacks for marketing purposes. Such stacked loading of the containers and caps subjects the packages to large vertical loads which could distort and permanently deflect the outer cap of the closures to a position in which only twisting movement is required to remove the caps from the container thereby destroying its purpose.

It is an object of the present invention to provide a screw-type safety closure in which provision is made to absorb axial loads thereby permitting containers employing such closures to be stacked for either shipment or display.

The objects of the invention are obtained by providing a screw-type closure having a relatively flexible outer cap and a relatively rigid inner cap nested together and forming an annular zone between the caps with a plurality of ribs being disposed on one of the caps and in the annular zone in uniformly spaced relationship and a like number of lug elements are formed in the annular zone on the other of the caps. Each of the lug elements has a first drive surface engageable with a rib to turn the caps as a unit in the closing direction and a second drive surface normally axially spaced so that it cannot engage the ribs upon relative rotation but which is engageable with the ribs upon axial deflection of the periphery of the outer cap and simultaneous rotation of the outer cap relative to the inner cap so that the two caps turn as a unit in an opening direction. The ribs and lugs are provided with complementary load bearing surfaces which engage each other in a particular location of the caps relative to each other to prevent axial displacement and absorb the axial loads that may be imposed on the closure by other containers in the same packing container or in a display. The caps have their load bearing surfaces engaged with each other when the ribs are in a driving relationship to turn the closure on a container in a closing direction and means are provided to resist relative rotation of the caps away from this position until there is an application of some force greater than that which would be encountered by vibration or the like to move the caps relative to each other to an opening position in which the caps can be deflected axially relative to each other to bring about the necessary driving engagement for opening movement of the closure.

A preferred embodiment of the invention is described in the following description and is illustrated in the drawings in which.

Figure 1:
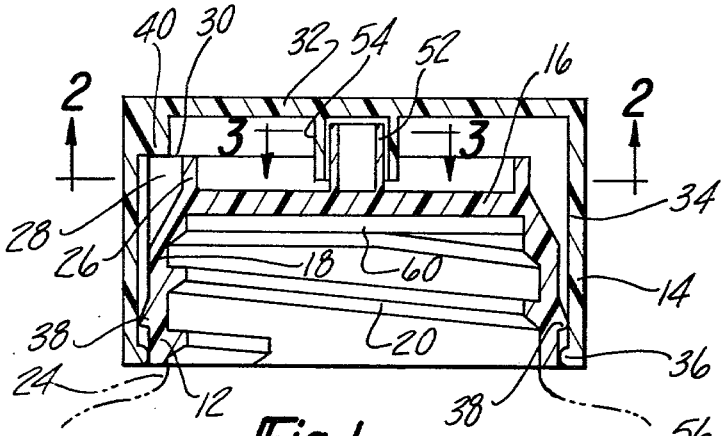
FIG. 1 is a cross-sectional view of a closure embodying the invention.

A closure embodying the invention as designated generally at 10 and includes an inner cap 12 and an outer cap or driver 14. The cap 12 has a flat, circular top 16 and a cylindrical skirt 18, the inner surface of which is provided with helical threads 20 adapted to mate with complementary threads on a conventional bottle neck indicated in broken line at 24.

The cap 12 has an annular rim 26 formed integrally with the cap top 16. A plurality of ribs 28 are formed on the outer surface of the skirt 18 and rim 26 to extend generally axially and have an upper surface 30 at the same level as the rim 26. The ribs 28 are uniformly spaced circumferentially of the cap 12 and preferably two or more such ribs 28 are used with three being illustrated in the drawings spaced 120° apart.

The driver 14 has a flat disc-shaped top 32 and a depending cylindrical skirt 34 to telescope over the cap 12. The cap 12 and driver 14 are disposed concentrically in nested relationship and the skirt 34 is provided with a radially inwardly directed lip 36 which is engageable with a radially outwardly extending flange 38 on the cap 12 to to permit limited axial movement of the cap 12 and driver 14 but maintain them in assembled and nested relationship.

A series of driving lugs 40 are formed integrally with the driver 14 at the junction of the driver top 32 and skirt 34. The driving lugs or members 40 correspond in number and spacing to the ribs 28 on the cap 12. Both the driving members 40 and the ribs 28 are annularly aligned in that the annulus on which the lugs 40 are located is approximately the same diameter as the annulus on which the ribs 28 are located. In that manner, the driver skirt 34 and rim 26 form an annular zone therebetween in which the ribs 28 and lugs 40 are located.

Figure 4:
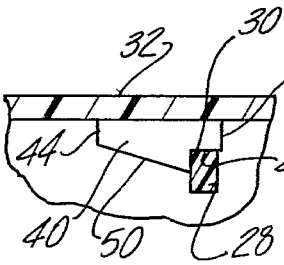
FIG. 4 is a fragmentary sectional view taken on line 4—4 in FIG. 2.

Each of the lugs 40 extends arcuately between the rim 26 and the driver skirt 34. Each lug 40 has a pair of oppositely facing surfaces 42 and 44 with the forward surface 42 having a slightly larger axial extent than the rear surface 44. In addition, when the closure 10 is in its initially closed condition as illustrated in FIG. 4 of the drawings, the forward surface 42 extends downwardly to the height of the top surface 30 of the ribs 28. The lugs 40 also each have a shoulder 46 and an adjoining pad surface 48 which engages the side of the ribs 28 and the top surface 30, respectively. The shoulder 46 and the rear surface 44 are joined by an inclined cam or ramp surface 50.

Both the cap 12 and driver 14 are molded from a plastic material, for example, polystyrene or polypropylene, with the cap 20 of a relatively stiffer or more rigid plastic material than the driver 14. The driver 14 may be of the same material but with a greater content of plasticizer to make the driver relatively more flexible. The cap 12 and driver 14 are held apart at their axes by spacer means in the form of telescoping collars 52 and 54 formed on the driver 14 and cap 12, respectively. The collars 52 and 54 are concentric with each other and coaxial with the cap 12 and driver 14 and serve to maintain the axial relationship of the cap and driver along the axis of the closure 10. The collars 52 and 54 are provided with axially extending ribs or protrusions 56 and 58, respectively. The ribs 56 and 58 extend radially toward each other as seen in FIG. 3 to interfere with each other upon relative rotation of the collars 52 and 54.

Figure 3:
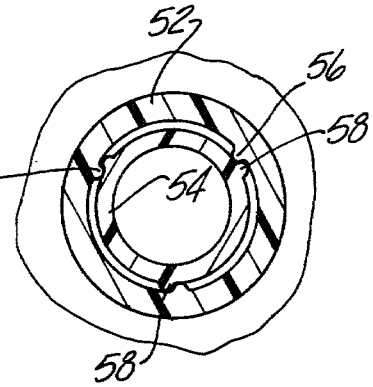
FIG. 3 is a fragmentary view of the center portion of the closure seen in FIG. 2 but at an enlarged scale.
Figure 2:
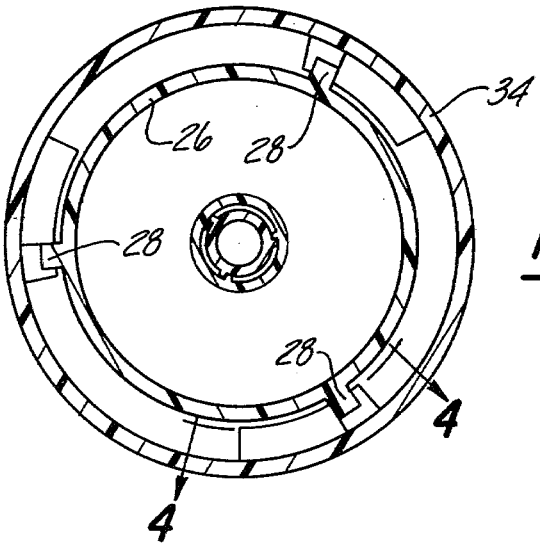
FIG. 2 is a cross-sectional view taken on line 2—2 in FIG. 1.

In order to screw the closure 10 onto a threaded neck such as the neck 24, the driver 14 is held by a person or an automatic capping machine, not shown, and the closure 10 is rotated relative to the neck 24 with torque being transmitted from the driver 14 to the cap 12 by means of the shoulders 46 on the lugs 40 simultaneously engaging the side surfaces of the ribs 28 as seen in FIGS. 2, 3 and 4. Sufficient torque can be applied so that a liner or seal 60 comes into tight sealing engagement with the top surface of the neck 24.

To remove the closure 10 from the neck 24, the cap 12 must rotate in the opposite direction, that is, counter-clockwise as seen in the bottom view of the closure 10 in FIG. 2 or clockwise in FIG. 3.

Figure 5:
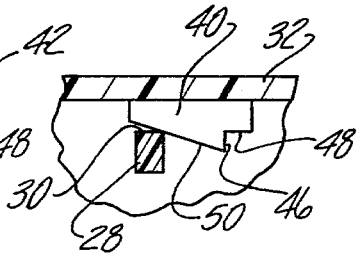
FIGS. 5 and 6 are views similar to FIG. 4 but showing other conditions of operation of the closure.

During rotation of the outer cap or driver 14 in an opening direction, namely in a clockwise direction when the closure is viewed form the bottom as illustrated in FIG. 2, the cap 12 remains threadably engaged with the neck 24 causing the driver 14 and in particularly the lugs 40 to move out of engagement with the ribs 28. If the driver 14 is rotated more than 120° in the clockwise direction, the ramp surfaces 50 will come into engagement with the next adjacent rib 28 as illustrated in FIG. 5. The ramp surface 50 will cause the driver 14 to move axially relative to the cap 12 and permit the ramp surfaces 50 to pass over the relatively stationary ribs 28 past the shoulders 46 and the forward surfaces 42. In this manner the driver 14 can be racheted or rotated relative to the cap 12 with the ramp surfaces 50 serving to deflect the driver 14 relative to the cap 12 so that insufficient torque is transmitted to remove the cap 12.

Figure 6:
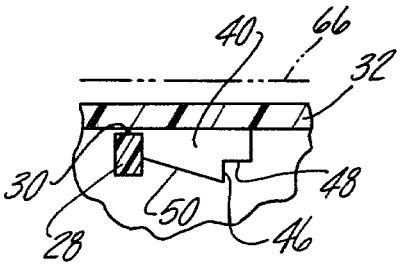

When it is desired to remove the cap 12 from the neck 24, downward pressure is applied to the outer periphery or annular portion of the driver top 14 adjacent the lugs 40 to deform the driver 14 downwardly or axially from the broken line position indicated by line 66 in FIG. 6. Subsequent rotation of the driver 14 in a clockwise direction as viewed in FIG. 2 brings the surfaces 44 into engagement with the side surfaces of the ribs 28 as seen also in FIG. 6. In the deformed condition of the driver 14 upon simultaneous rotation, torque is applied from the driver 14 to the cap 12 to unscrew the cap 12 from the neck 24.

Replacement of the cap requires rotation in an opposite direction, that is in a counter-clockwise direction as viewed in FIG. 2. Rotation of driver 14 causes simultaneous rotation of cap 12 until cap 12 meets resistance on the neck of the bottle after which the shoulder 46 is brought back into engagement with side surfaces of the ribs 28. Thereafter, the cap 12 and driver 14 can be turned as a unit to bring the complementary threads 20 on cap 12 and bottle 24 into engagement with each other so that the closure 10 can be resealed.

Upon application of the closure 10 to the neck of the container 24 for the first time after the associated container has been filled, the shoulder 46 on the lugs 40 are in engagement with the ribs 28 so that the cap 12 and driver 14 turn as a unit to bring the threads 20 and 22 into engagement with each other so that the closure 10 can be tightened on the neck 24 to bring about sealing engagement between the liner 60 and the top of the neck 24. In that condition the pad surface 48 is in engagement with the top surface 30 of the ribs 28 as best seen in FIG. 4. As a consequence, axial loads such as those that would be encountered if containers are stacked one upon the other are absorbed by the ribs 28 so that there is no deformation of the relatively deflectable driver 14. At the same time the pad surfaces 48 are in engagement with the top surfaces 30 of the ribs 28 the small interfering ribs 56 and 58 bear the relationship seen in FIG. 3. Under those conditions the ribs 56 and 58 engage each other to prevent relative rotation of the collars 52 and 54 and therefore relative rotation of the cap 12 and the driver 14. This insures that the pad or stack surfaces 48 remain in engagement with the top surfaces 30 of the ribs 28.

The relative dimensions and surfaces of the collars 52 and 54 as well as the ribs 56 and 58 can be accurately controlled so that force resisting relative movement of the cap 12 and driver 14 can be only sufficiently large to insure that the cap 12 and driver 14 maintain the desired stack relationship during packing, handling, shipping and unpacking for display. However, when an attempt is made to remove the closure 10, the driver 14 is easily moved relative to the cap 12 by overcoming without loosening the inner cap 12 even by a child when the driver 14 is moved in a direction for removing the closure 10. However, in that instance unless the driver 14 is deflected to bring the surfaces 44 into engagement with the sides of the ribs 28 the driver 14 can be racheted and rotated relative to the cap 12 without transmitting the torque necessary to remove it from the container.

A screw-type closure has been provided which requires deflection and simultaneous turning movement to remove the closure from a container and one which is provided with load bearing surfaces which prevent the axial deflection required for opening movement except when the cap is rotated to another position with the load bearing surfaces affording means of absorbing axial loads of the type encountered when containers are packed in quantity for shipment or are stacked for marketing displays.

The embodiments of the invention in which an exclusive property or privilege is claimed are defined as follows:

1. A screw-type closure comprising: a relatively flexible outer cap and a relatively rigid inner cap nested together and forming an annular zone between said caps, a plurality of ribs disposed on one of said caps in uniformly spaced relationship in said annular zone, a plurality of lug elements formed on the other of said caps and corresponding in number to the number of said ribs, each of said lug elements having a first drive surface engageable with a rib to turn said caps as a unit to a closing position on a container and a second drive surface normally spaced axially of said ribs to prevent engagement therewith upon rotation of said outer cap in an opening direction relative to said inner cap, said second drive surfaces being engageable with said ribs upon axial deflection of said outer cap and simultaneous rotation relative to said inner cap to turn said caps as a unit in an opening direction for removing said closure from a container, said ribs and lug elements having complementary load bearing surfaces engageable with each other upon rotation of said inner and outer caps to a predetermined position to prevent axial displacement of said outer cap relative to said inner cap and absorb axial loads on said closure.

2. The closure of claim 1 wherein said load bearing surfaces are in engagement with each other upon engagement of said first drive surfaces with said ribs upon rotation of said caps in a closing direction.

3. The screw type closure of claim 2 wherein one of said load bearing surfaces is formed at one end of each of said ribs and the other of said load bearing surfaces is formed on said lugs adjacent said first drive surface.

4. The screw-type closure of claim 1 and further comprising spacer means adjacent to the common axis of said caps to prevent axial displacement of said caps at their axis and maintain said second drive surfaces axially spaced relative to said ribs during axial deflection at the perimeter of said outer cap to permit engagement of said second drive surfaces with each other upon rotation of said outer cap in an opening direction.

5. The screw-type closure of claim 4 wherein said spacer means have elements contacting each other when said load bearing surfaces are in engagement with each other to resist rotation of said outer cap relative to said inner cap to resist separation of said load bearing surfaces preventing axial deflection of said outer cap.

6. The screw-type closure of claim 5 wherein said means resist rotation of said caps relative to each other with a maximum force substantially less than the force required to move said caps as a unit in an opening direction.

7. The screw-type closure of claim 4 wherein said spacer means are telescoped elements on said caps at the axis thereof and wherein said resistance portions are ribs at the outer surface of one and inner surface of the other of said elements engageable with each other to resist rotation of said caps from said load supporting position.

8. The screw-type closure of claim 1 wherein said first and second drive surfaces on each of said lugs are separated by a cam surface engageable with said ribs to deflect the perimeter of said outer cap relative to said inner cap and permit relative rotation of said caps in an opening direction but preventing removal of said closure.

9. The screw-type closure of claim 1 wherein said ribs are formed on said inner cap and wherein said lugs are formed on said outer cap.

10. A screw-type closure comprising: a cap member of relatively rigid material having a disc-shaped top and a cylindrical skirt, a driver member of relatively flexible material having a disc-shaped top and a cylindrical skirt, said cap member being disposed within said driver member, a plurality of ribs disposed on said cap member in uniformly spaced relationship adjacent to the circumference of said driver member, a plurality of lug elements on said driver member corresponding in number to the number of ribs and being annularly aligned with said ribs, each of said lug elements having a first drive surface engageable with a rib to turn said cap and driver as a unit in a closing direction on a container, a second drive surface normally spaced axially of said ribs to prevent engagement therewith upon rotation of said driver member in an opening direction relative to said cap, said second drive surfaces being engageable with said ribs upon axial deflection of said driver relative to said cap to turn said driver and cap as a unit in an opening direction for removing said cap from said container, a cam surface formed between said first and said second drive surfaces and being engageable with said ribs to deflect said cap and driver axially of each other to prevent engagement of said second drive surface with said lug upon rotation of said driver in an opening direction, and a load bearing portion formed adjacent each of said first drive surface and being axially engageable with said ribs when said first drive surfaces are, in driving engagement with said ribs to prevent axial displacement of said driver relative to said cap to sustain axial loads on said closure, and means resisting relative rotation of said caps from a position in which said load bearing surfaces are axially engaged with said ribs, said rotation being resisted with a force substantially less than the force required to rotate said caps as a unit.

11. The screw-type closure of claim 10 wherein said means resisting rotation of said caps includes a pair of telescoping collars at the common axis of said caps and interfering ribs on said collars.

* * * * *